US006073595A

United States Patent [19]

Brogdon

[11] Patent Number: 6,073,595

[45] Date of Patent: Jun. 13, 2000

[54] ENGINE CONSTRUCTION

[75] Inventor: James W. Brogdon, Daphne, Ala.

[73] Assignee: Teledyne Industries, Inc., Los Angeles, Calif.

[21] Appl. No.: 08/991,666

[22] Filed: Dec. 16, 1997

[51] Int. Cl.[7] ..... F02F 7/00

[52] U.S. Cl. ..... 123/55.5; 123/193.3

[58] Field of Search ..... 123/55.7, 55.5, 123/193.2, 193.3

[56] References Cited

U.S. PATENT DOCUMENTS

| | | | |
|---|---|---|---|
| 2,700,964 | 2/1955 | Nallinger | 123/193.3 |
| 2,769,438 | 11/1956 | Witzky | 123/193.3 |
| 3,316,688 | 5/1967 | Bachle | 123/193.3 |
| 3,744,462 | 7/1973 | Herschmann et al. | 123/193.3 |
| 4,387,678 | 6/1983 | Tholen | 123/193.3 |
| 4,630,345 | 12/1986 | Lutz | 123/193.3 |
| 4,977,864 | 12/1990 | Grant | 123/55.7 |
| 5,579,729 | 12/1996 | Batzill et al. | 123/55.5 |

*Primary Examiner*—Marguerite McMahon
*Attorney, Agent, or Firm*—Gifford, Krass, Groh, Sprinkle, Anderson & Citkowski, P.C.

[57] ABSTRACT

An in-line opposed cylinder engine constructed of a pair of half blocks which when combined form a pair of spaced cylinder heads and an intermediate crankcase and in which the cylinder heads and the intermediate crankcase are tied together by a plurality of spaced elongated through bolts which extend through the cylinder heads and through the half blocks. Each cylinder head is integral with the remainder of the half block and is preferably of a composite construction with a core of steel or the like which forms the cylinder bore, the firing deck, the exhaust ports and the valve guide as well as the main bearing supports. A matrix structure of lighter material such as aluminum is cast around the core and forms the induction air passages to the intake ports, the coolant passages, oil passages, and the main bearing bosses.

13 Claims, 4 Drawing Sheets

ENGINE CONSTRUCTION

FIELD OF THE INVENTION

The present invention relates to internal combustion engines, and more particularly to a lightweight engine having directly opposed cylinders and such an engine especially suited for high pressure combustion such as a diesel engine.

DESCRIPTION OF THE PRIOR ART

Opposed cylinder internal combustion engines are not new. U.S. Pat. No. 2,489,068 issued to Carlson, for instance, discloses such an engine. Such engines however, have been quite heavy. The present invention provides an opposed engine which has a lightweight construction making it especially suitable as the means for propelling lightweight general aircraft. Other patents which disclose opposed cylinder internal combustion engines include U.S. Pat. No. 1,639,334 issued Aug. 16, 1927 to Ford; U.S. Pat. No. 2,093,433 issued Sep. 21, 1937 to Greene; and U.S. Pat. No. 2,275,478 issued Mar. 10, 1942 to Taylor.

None of these patents discloses an in-line opposed cylinder engine having the lightweight characteristics of the present invention and yet which is capable of the high combustion chamber pressures which enables the engine to be a diesel engine. The construction of the engine of the present invention makes it especially useful in a lightweight single engine general aviation aircraft or in other applications where a high weight to power ratio is important such as in transportable generator sets and marine propulsion engines.

SUMMARY OF THE INVENTION

The present invention provides an opposed cylinder internal combustion piston engine constructed to provide an engine capable of reliability with the construction permitting a relatively high combustion pressure within a light weight structure. The preferred embodiment of the engine of the present invention is a two cycle, direct injected, compression ignition engine that uses Jet-A fuel. The preferred engine includes horizontally opposed pistons and cylinders with a single crankshaft between the pistons and rotated by pairs of opposed pistons. This provides a flat configuration and the engine includes innovations in the construction and in the way that the parts of the engine are fastened together to significantly reduce weight without sacrificing power and reliability. While the preferred embodiment of the present invention, which will be subsequently described in detail, is in the form of a two stroke diesel engine with four cylinders it will be apparent that the engine of the present invention could be a four stroke engine with 2, 6, 8, 10, 12 or more cylinders. It could also be a spark plug ignited engine.

The engine of the present invention is constructed of a pair of mating half blocks each of which includes an integral cylinder head and which together form the engine block and the crankcase as well as a pair of oppositely positioned cylinder heads of the engine. The half blocks of the engine are joined by a plurality of spaced, quite long, through bolts which extend between the opposed cylinder heads and through the half blocks. The opposing cylinders of the engine are on the same centerline and this permits the through bolts to extend completely through the engine to tie the parts together. The through bolts provide for direct transfer of the cylinder firing forces from the cylinder heads to the main engine bearings. The transfer is accomplished in tension and compression with little bending for the most efficient use of material strength. The linking of the opposed cylinder heads by the long through bolts also provides a composite beam of exceptional stiffness for support of the engine main bearings and crankshaft. This stiffness is essential in providing even force distribution on the main and crank pin bearings to thereby promote bearing life.

In addition the engine of the present invention includes a composite engine block and cylinder head structure. The half blocks are of a composite structure which includes a core that preferably forms the cylinder bores, the firing decks, the exhaust ports and the valve guides. The core can be of single casting, such as steel, or it can also be a composite structure such as in the form of separate cylinder barrels welded or otherwise joined to the firing deck and port casting. Around the core is cast a matrix structure of aluminum or some other light alloy. The matrix structure preferably contains the induction air passages to the intake ports, the coolant passages, the oil passages, and the main bearing bosses.

The composite structure results in the firing pressure in the cylinders being transmitted through the steel cores to the through bolts and to the through bolt bosses between and beside the cylinders and thence through the matrix structures to the main bearings. This provides the necessary lightweight for an engine such as an aircraft engine without sacrificing power.

BRIEF DESCRIPTION OF THE DRAWINGS

A better understanding of the present invention will be had upon reference to the following detailed description when read in conjunction with the accompanying drawings in which.

DETAILED DESCRIPTION OF A PREFERRED EMBODIMENT OF THE PRESENT INVENTION

Figure 1:
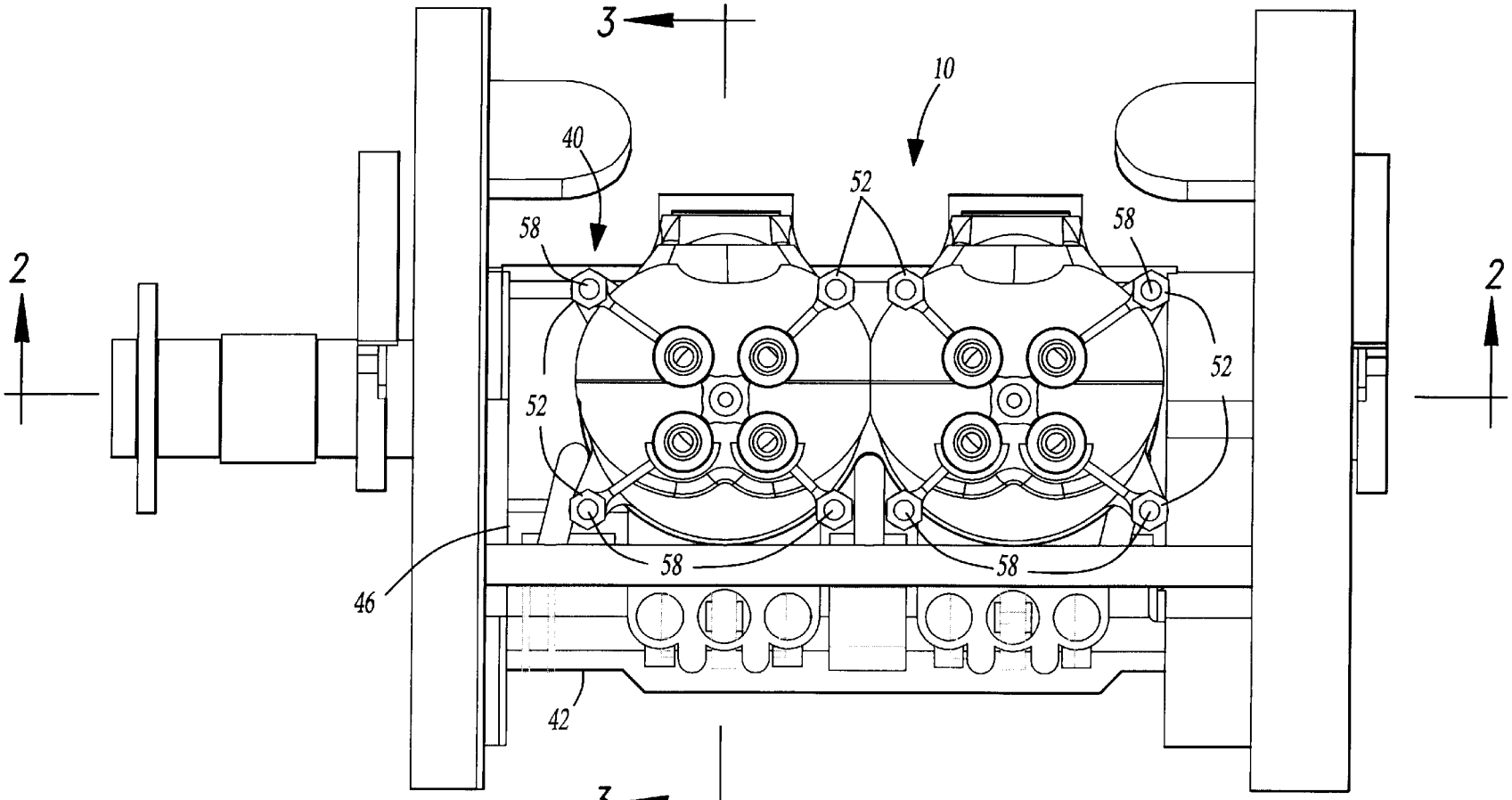
FIG. 1 is a side elevational view of a preferred embodiment of the present invention.

With reference to the drawings, a preferred embodiment of the present invention is illustrated as comprising an engine 10 having at least a pair of opposed pistons 12 and 14 connected by connecting rods 16 and 18 and bearings 21, respectively, to a crankshaft 20 between the pistons 12 and 14. The pistons 12 and 14 are connected to the crankshaft 20 by a bearing 21 and have their centerlines aligned.

Figure 2:
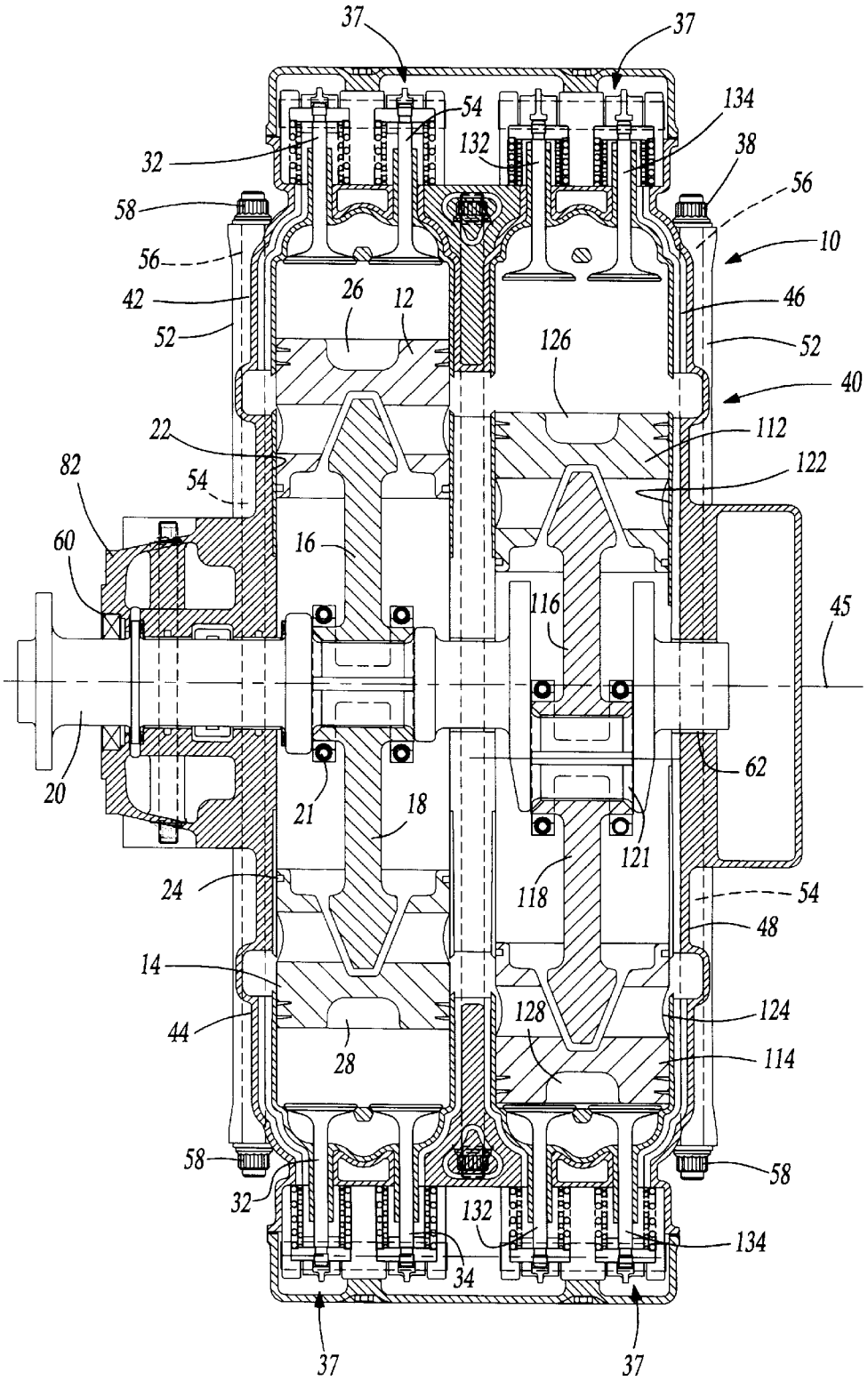
FIG. 2 is a cross sectional view taken substantially on line 2—2 of FIG. 1.

As can best be seen in FIG. 2 the engine 10 of the preferred embodiment is a four cylinder engine so that a second set of pistons 112 and 114 is also connected to the crankshaft 20 but by connecting rods 116 and 118 respectively and bearings 121.

Still referring to FIG. 2 the pistons 12 and 14 move reciprocally within a pair of cylinders 22 and 24 respectively and the pistons 112 and 114 move reciprocally within cylinders 122 and 124 respectively in response to combustion in combustion chambers 26, 28 and 126, 128 formed in part in the top of the pistons 12, 14, 112, and 114 respectively.

Figure 3:
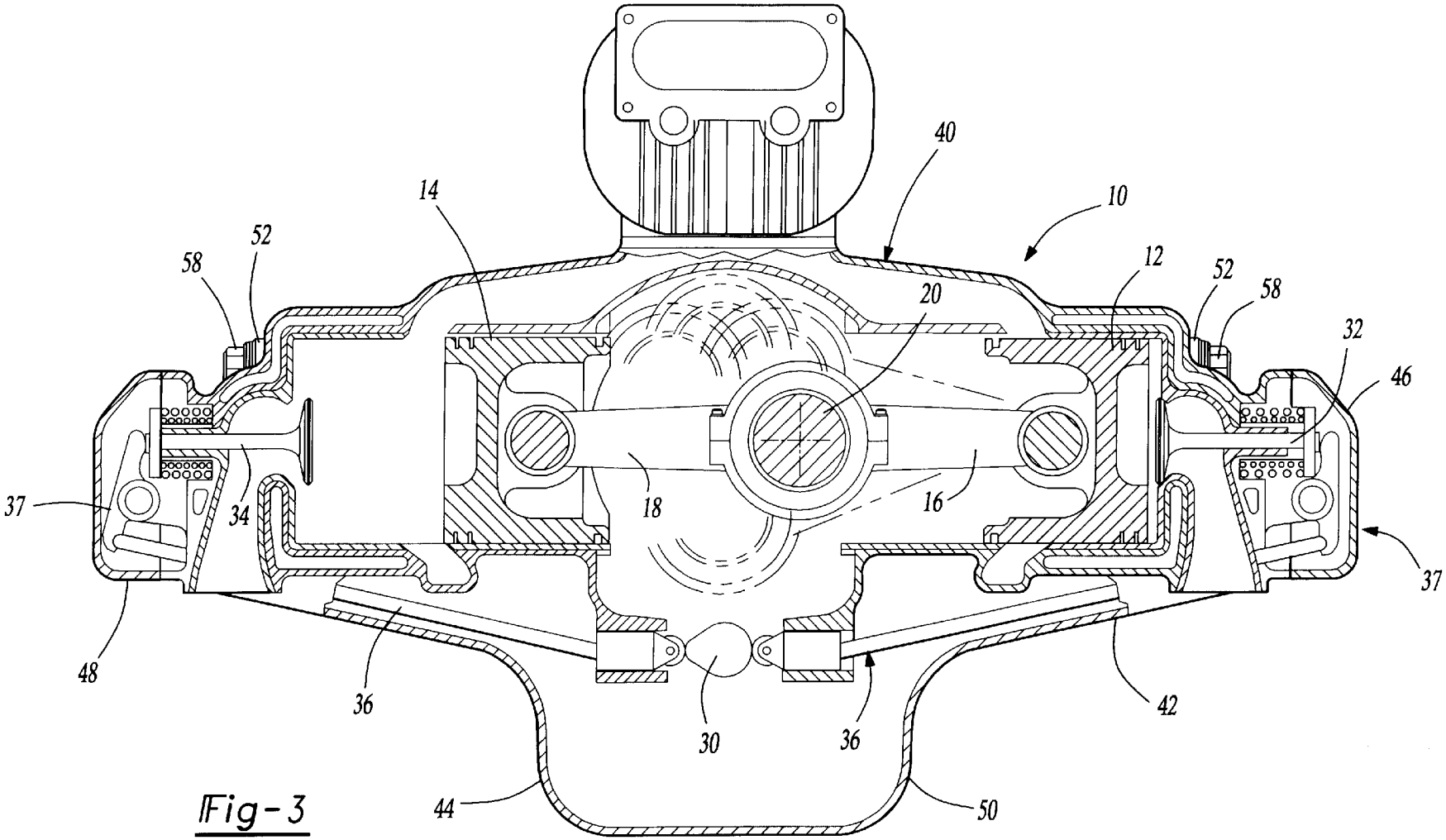
FIG. 3 is a cross sectional view taken substantially on line 3—3 of FIG. 1.

As can best be seen in FIG. 3 a camshaft 30 actuates valves 32 and 34 through a rod 36 and a conventional rocker arm assembly 37. As shown in FIG. 2 exhaust and intake valves 132 and 134 are also provided for the second set of pistons 112 and 114. They too are actuated by the cam 30 and the rocker arm assembly 37.

The housing 40 of the engine is made up of a pair of half blocks 42 and 44 joined at a separation plane 45 (FIG. 2) as will be discussed later. The half blocks 42 and 44 form opposed cylinder heads 46 and 48, and an intermediate crankcase 50 (FIG. 3) sandwiched between the cylinder heads 46 and 48. To tie the half blocks 42 and 44 together and thus to tie the cylinder heads 46 and 48 and the crankcase 50 together, a plurality of bosses 52 are formed in the cylinder heads 46 and 48 and in the half blocks 42 and 44. This can best be seen in FIG. 2. The bosses 52 have through holes 54 which provide the means for long through bolts 56 which extend through the cylinder head 46, the half blocks 42 and 44 and through the cylinder head 48 to sandwich the crankcase 50 between the cylinder heads 46 and 48 when the through bolts 56 are secured by nuts 58 carried at each end of the through bolts 56.

The crankshaft 20 is supported at the juncture of the joined half blocks 42 and 44 and by bearings 60 and 62 (FIG. 2) and is rotationally driven by the pistons 12 and 14 and the pistons 112 and 114 on opposite sides of the crankshaft 20 upon combustion in the combustion chambers 26, 28, 126, 128 in the conventional manner. The engine 10 illustrated in the drawings is a two stroke diesel engine which requires high combustion pressures in the cylinders 22, 24, 122, 124 although it is apparent that other conventional combustion means can be employed and the engine 10 could be a four stroke spark ignited engine just as well.

Each of the mating half blocks 42 and 44 is integral with its corresponding cylinder head 46 and 48 which separately form half the engine block 40 and half the crankcase 50 for the engine 10. The half blocks 42 and 44 are joined by the through bolts 56 which extend between the opposed cylinder heads 46 and 48 and through the half blocks 42 and 44. The opposing cylinders 22 and 24 and 122 and 124 respectively of the engine 10 are on the same centerline and this permits the through bolts 56 to extend completely through the cylinder heads 46 and 48 and the half blocks 42 and 44 to tie the parts together. The through bolts 56 provide for direct transfer of the cylinder firing forces from the cylinder heads 46 and 48 to the main engine bearings 60 and 62. The transfer is accomplished in tension and compression with little bending for the most efficient use of material strength. The linking of the opposed cylinder heads 46 and 48 by the long through bolts 56 also provides a composite beam of exceptional stiffness for support of the engine main bearings 60, 62 and the crankshaft 20. This stiffness is essential in providing even force distribution on the main bearings 60, 62 and crank pin bearings 21, 121 which promotes bearing life.

Figure 4:
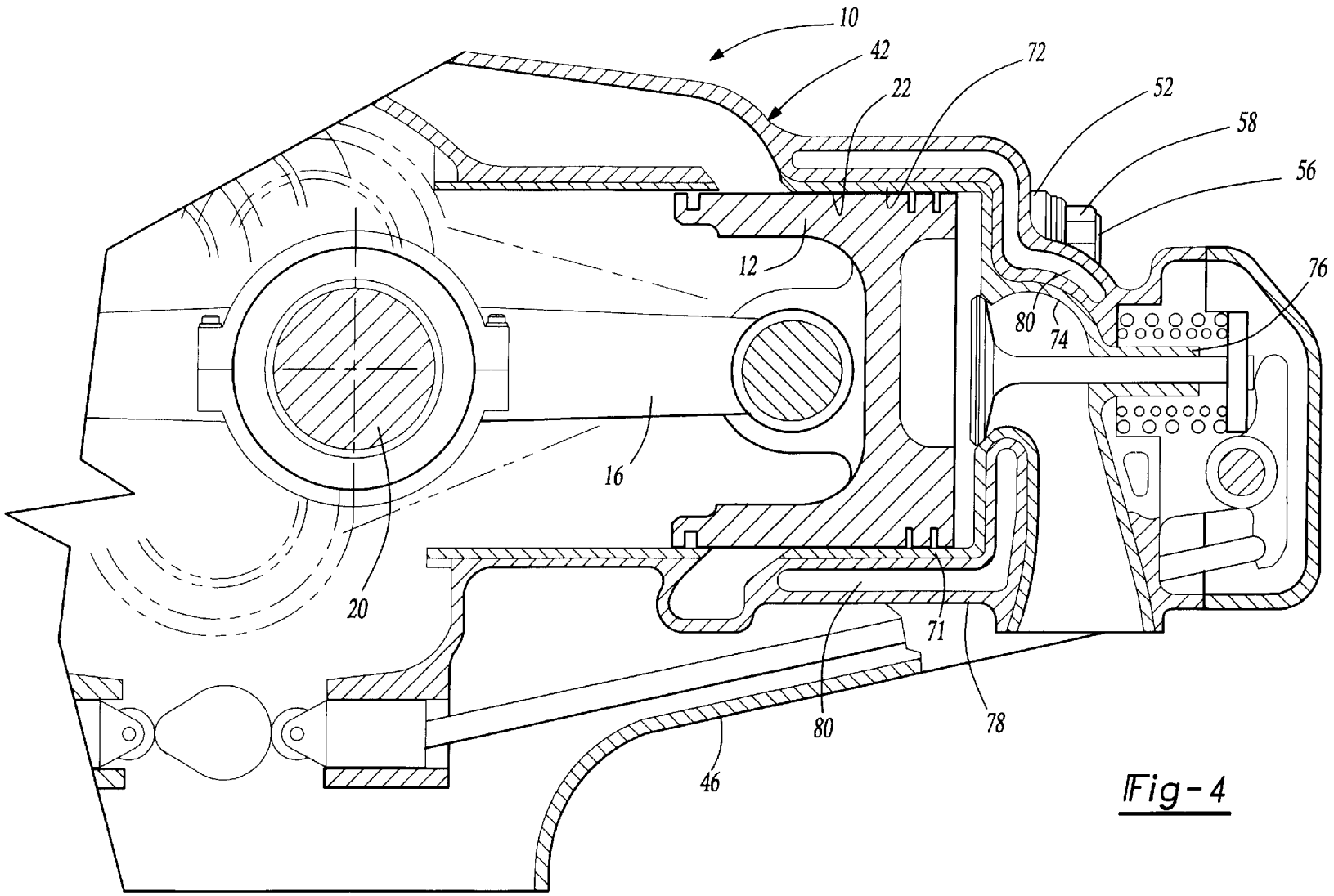
FIG. 4 is an enlarged, fragmentary cross sectional view of a portion of the structure shown in FIG. 3.

In addition the engine 10 of the present invention includes a composite engine block and cylinder head structure. This can best be seen in FIG. 4 which shows an enlarged portion of the structure shown in FIG. 3. The half blocks 42 and 44 which make up the engine block 40 and cylinder heads 46 and 48 are preferably of a composite structure which includes a core 70 that preferably forms the cylinder bores 22, 24, 122, and 124, the firing decks 72, the exhaust ports 74 and the valve guides 76. The core 70 can be of single casting, such as steel, or it can also be a composite structure such as in the form of separate cylinder barrel 71 welded or otherwise joined to a firing deck 72 and a port casting 74. Around the core 70 is cast a matrix structure 78 of aluminum or some other light alloy. The matrix structure 78 preferably contains the induction air passages (not shown) to the intake ports (not shown) the coolant passages, 80, the oil passages (not shown) and the main bearing bosses 82 (FIG. 2).

The composite structure results in the firing pressure in the cylinders 26, 28, 126, 128 being transmitted through the steel firing cores 70 to the through bolts 56 and to the through bolt bosses 52 between and beside the cylinders 26, 28, 126, 128 and thence through the matrix structure 78 to the main bearings 60 and 62. This provides the necessary lightweight for an engine for general aviation aircraft or for other applications where lightweight engines are important. The engine also provides a relatively flat configuration and therefore has particular use as an aircraft engine for small general aviation aircraft where space is a premium.

Although the engine of the present invention has been described as providing an opposed cylinder internal combustion engine constructed to provide an engine sufficiently lightweight so that it can be used to propel light aircraft it should be apparent from the description that the engine could be used in other applications as well where light weight engines are desirable such transportable generator sets or for marine propulsion.

Also although the preferred embodiment of the engine of the present invention has been described as a two cycle, direct injected, compression ignition engine with four cylinders it is apparent that the engine could be a four stroke engine with 2, 6, 8, 10, 12 or more cylinders without departing form the invention. It could also be a spark plug ignited engine.

Having described my invention, however, it is also apparent that many other modifications can be made thereto without departing from the spirit of the invention as defined by the scope of the appended claims.

I claim:

1. An internal combustion engine comprising:

a pair of opposed cylinders and a pair of pistons movable respectively within said cylinders in response to combustion being produced within said cylinders;

a crankshaft and said pistons being connected to said crankshaft to rotate said crankshaft upon reciprocating movement of said pistons within said cylinders;

said pistons being mounted to said crankshaft such that the centerlines of said pistons are axially aligned;

an engine block enclosing said pistons and said crankshaft and comprising a first cylinder head and a second cylinder head, said second cylinder head being spaced from said first cylinder head; and a plurality of through bolts, each of said through bolts extending through a portion of said first cylinder head, through said engine block and into said second cylinder head to fasten said cylinder heads and said engine block together.

2. The engine as defined in claim 1 and in which said first and second cylinder heads each include a cylinder liner of relatively heavy metal material and a lighter metallic material formed over said liner.

3. The engine as defined in claim 2 and including cooling chambers formed in said lighter metallic material.

4. The engine as defined in claim 1 and in which said engine block is formed of a first and a second half block joined together;

said each of through bolts extending completely through said first and said second cylinder heads and through said first and said second half blocks.

5. The engine as defined in claim 4 and in which said first cylinder head is integral with said first half block and said second cylinder head is integral with said second half block.

6. The engine as defined in claim 4 and in which said crankshaft is supported at the juncture of said half blocks.

7. The engine as defined in claim 2 and in which each of said through bolts extends through said heavy metal material.

8. The engine as defined in claim 1 and in which each of said through bolts extends completely through said first cylinder head, said engine block and said second cylinder head.

9. An internal combustion engine comprising:

a pair of opposed cylinders and a pair of pistons movable respectively within said cylinders in response to combustion being produced within said cylinders;

a crankshaft and said pistons being connected to said crankshaft to rotate said crankshaft upon reciprocating movement of said pistons within said cylinders;

said pistons being mounted to said crankshaft such that the centerlines of said pistons are axially aligned;

an engine block enclosing said pistons and said crankshaft and comprising a first half block and a second half block and fasteners extending through at least a portion of said first half block and a portion of said second half block to fasten said half blocks together;

said first and second half blocks each including a core of relatively heavy metal material and a lighter metallic matrix formed over said core; and said first halfblock including a first cylinder head and said second halfblock including a second cylinder head spaced from said first cylinder head, said first cylinder head being integrally formed with said first half block and said second cylinder head being integrally formed with said second half block.

10. The engine as defined in claim 9 and further comprising;

said core including a cylinder liner affixed to said first cylinder head and a cylinder liner affixed to said second cylinder head.

11. The engine as defined in claim 10 and including an exhaust valve, a port communicating with said cylinder bore through said exhaust valve, said cylinder liners each forming a cylinder bore and said core forming said cylinder liners also forming a firing deck adjacent said cylinder bore, and a valve guide supporting said exhaust vault.

12. The engine as defined in claim 9 and in which said matrix forms an intake port communicating with said cylinder liner, a coolant passage formed in said half block and a main bearing boss formed in said half block.

13. The engine as defined in claim 9 and in which said crankshaft is supported between said half blocks.

* * * * *

UNITED STATES PATENT AND TRADEMARK OFFICE

CERTIFICATE OF CORRECTION

PATENT NO. : 6,073,595
DATED : June 13, 2000
INVENTOR(S) : James W. Brogdon

It is certified that error appears in the above-identified patent and that said Letters Patent is hereby corrected as shown below:

Column 1,
Line 14, after “engines” insert -- heretofore --.

Column 4,
Line 27, after “departing”, delete “form” and replace therewith -- from --.

Signed and Sealed this

Sixth Day of July, 2004

JON W. DUDAS
*Acting Director of the United States Patent and Trademark Office*